US005405523A

United States Patent [19]

Eckles

[11] Patent Number: 5,405,523

[45] Date of Patent: Apr. 11, 1995

[54] ZINC ALLOY PLATING WITH QUATERNARY AMMONIUM POLYMER

[75] Inventor: William E. Eckles, Cleveland Heights, Ohio

[73] Assignee: Taskem Inc., Cleveland, Ohio

[21] Appl. No.: 167,667

[22] Filed: Dec. 15, 1993

[51] Int. Cl.[6] ..... C25D 3/56

[52] U.S. Cl. ..... 205/245; 205/244; 205/246

[58] Field of Search ..... 205/244, 245, 246

[56] References Cited

U.S. PATENT DOCUMENTS

| | | | |
|---|---|---|---|
| 2,080,479 | 5/1937 | Hoff | 204/18 |
| 2,080,483 | 5/1937 | Hull | 204/18 |
| 2,080,520 | 5/1937 | Westbrook | 204/18 |
| 4,157,388 | 6/1979 | Christiansen | 424/70 |
| 4,581,110 | 4/1986 | Tsuchida et al. | 204/44.2 |
| 4,861,442 | 8/1989 | Nishihama et al. | 205/246 |
| 4,877,496 | 10/1989 | Yanagawa et al. | 205/246 |
| 4,983,263 | 1/1991 | Yasuda et al. | 205/246 |

*Primary Examiner*—John Niebling
*Assistant Examiner*—Kishor Mayekar
*Attorney, Agent, or Firm*—Tarolli, Sundheim & Covell

[57] ABSTRACT

A zinc alloy electroplating bath comprising zinc ions, alloy metal ions of a metal of the first transition of the Periodic Table, and a brightening agent comprising a ureylene quaternary ammonium polymer, an iminoureylene quaternary ammonium polymer, or a thioureylene quaternary ammonium polymer.

19 Claims, No Drawings

ZINC ALLOY PLATING WITH QUATERNARY AMMONIUM POLYMER

BACKGROUND OF THE INVENTION

1 . Technical Field

The present invention relates to zinc alloy electroplating baths, and to a novel brightening agent for such electroplating baths.

2 . Description of the Prior Art

Early work in the area of zinc alloy electroplating is disclosed in U.S. Pat. Nos. 2,080,479; 2,080,483; and 2,083,520, all assigned to E. I. DuPont de Nemours & Company. These patents relate to alkaline zinc and zinc alloy plating baths which contain cyanide. In U.S. Pat. No. 2,080,483, the bath also contains a thiourea. It is suggested in the '483 patent that the thiourea in combination with a group VIII metal exercises a synergetic effect to provide a brightness greater than that attributable to the use of a thiourea in an alloy-free zinc plating bath, or to a zinc alloy bath free of thiourea.

U.S. Pat. No. 4,581,110 discloses an alkaline cyanide-free zinc iron alloy plating bath. The bath contains, as a brightening agent, an aromatic aldehyde mixed with an amine reacted with epichlorohydrin.

Other known brightening agents for zinc and zinc alloy plating baths include sodium saccharin, anisic aldehyde, polyvinyl alcohol, polyethyleneimine, n-benzyl nicotinic acid (sodium salt), benzylidene acetone, and derivatives of polyethylene glycol.

Ureylene quaternary ammonium polymers are well known and have been assigned CAS Registry No. 68555-36-2. They are also disclosed in U.S. Pat. No. 4,157,388. They are sold by Miranol Chemical Company, Inc., a division of Ashland Chemical Company, under the trademark "MIRAPOL". They are conventionally used in such applications as cosmetics, hair and skin conditioners, cleaning compositions, and the retardation of scale in brine solutions.

SUMMARY OF THE INVENTION

The present invention resides in an aqueous bath suitable for electrodepositing zinc alloyed with metal ions of elements from the first transition of the Periodic Table. The bath comprises, as a brightening agent, a brightening amount of a ureylene quaternary ammonium polymer, an iminoureylene quaternary ammonium polymer, or a thioureylene quaternary ammonium polymer. A preferred brightening agent is a ureylene quaternary ammonium polymer.

The quaternary ammonium polymer of the present invention preferably has repeating groups of the formula

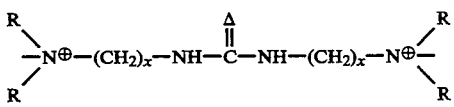

(1)

or the formula

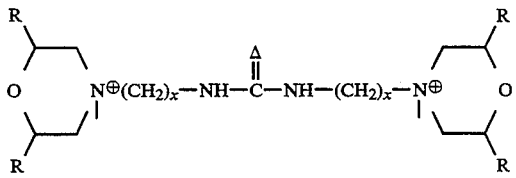

(2)

wherein

Δ is O, S, N, x is 2 or 3, and

R is methyl, ethyl, isopropyl, 2-hydroxyethyl, or $-CH_2CH_2(OCH_2CH_2)_yOH$, y being 0–6, in alternating sequence with ethoxyethane or methoxyethane groups. R can also be hydrogen in formula (2). The polymer has a molecular weight in the range of 350 to 100,000.

A preferred molecular weight of the polymer is in the range 350 to 2,000.

The present invention is applicable both to an alkaline bath having a pH in the range of about 9 to 13 or an acid bath having a pH in the range of about 3 to 7.

Preferably, the bath of the present invention comprises about 4,000 to about 50,000 parts per million of (ppm) zinc ions with about 20 to about 2,000 parts per million of iron, nickel, cobalt, manganese, chromium, or combinations thereof.

Preferably, the bath of the present invention, if alkaline, comprises a complexing agent. Examples of suitable complexing agents are tartaric acid, gluconic acid, heptanoic acid, ethylenediaminetetraacetic acid, and triethanolamine. The complexing agent is employed in an amount effective to prevent the alkaline hydrolysis of the alloying metal ions in the bath.

The present invention also resides in a process for electrodepositing a zinc alloy on a conductive substrate using any of the aforementioned plating baths.

DESCRIPTION OF PREFERRED EMBODIMENTS

The electroplating bath of the present invention can be either an alkaline bath having a pH in the range of about 9 to 13, or an acid bath having a pH in the range of about 3 to 7, preferably 3.5 to 6.2.

The brightening agent of the present invention is a ureylene quaternary ammonium polymer, an iminoureylene quaternary ammonium polymer, or a thioureylene quaternary ammonium polymer.

Preferably, the quaternary ammonium polymer has repeating groups of the formula

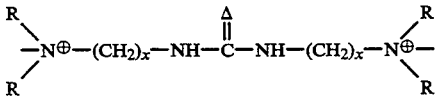

(1)

or formula

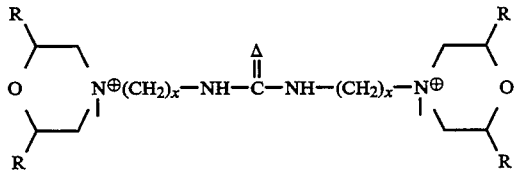

(2)

wherein

Δ is O, S, N, x is 2 or 3, and

R is methyl, ethyl, isopropyl, 2-hydroxyethyl, or $-CH_2CH_2(OCH_2CH_2)_yOH$, y being 0–6, in alternating sequence with ethoxyethane or methoxyethane groups. R can also be hydrogen in formula (2). The polymer has a molecular weight in the range of 350 to 100,000.

The quaternary ammonium polymers of the present invention are disclosed in part in U.S. Pat. No. 4,157,388. The disclosure of U.S. Pat. No. 4,157,388 is incorporated by reference herein. The ureylene quaternary ammonium polymers have been assigned CAS Registry No. 68555-36-2.

The quaternary ammonium polymers of the present invention can be prepared by first forming a ditertiary amine monomer. The ditertiary amine monomer is the condensation reaction product of two moles of a diamine containing one tertiary amine group and either one primary or one secondary amine group, (such as dimethylaminopropylamine) and one mole of urea, thiourea or guanidine. The ditertiary amine monomer has the formula

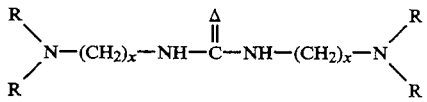

(3)

or the formula

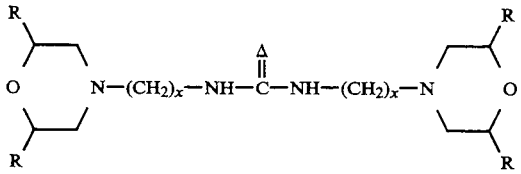

(4)

In formulae (3) and (4), Δ, x and R are the same as in formulae (1) and (2).

This monomer can then be reacted, in a second condensation reaction, with a dihalide monomer selected from the group consisting of an ethylene dihalide such as ethylene dichloride or dibromide, a bis(2-haloethyl)ether such as 1-chloro-2-(2-chloroethyoxy)ethane, a (halomethyl)oxirane such as 1-chloro-2,3-epoxypropane(epichlorohydrin) and a 2,2′-(ethylenedioxy)diethylhalide such as 2,2′-(ethylenedioxy)diethylchloride.

This second condensation reaction gives the quaternary ammonium polymer of formula (1) or formula (2) above.

A preferred quaternary ammonium polymer in the present invention is a ureylene quaternary ammonium polymer having the formula

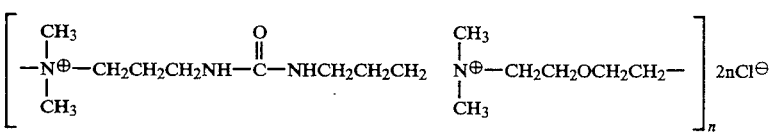

(5)

This compound is marketed by the Miranol Chemical Company under the trademark MIRAPOL A-15 and has an average molecular weight of about 2,200. The average value of n is six. The compound is readily soluble in a plating bath.

The amount of the quaternary ammonium polymer of the present invention added to an electroplating bath is a brightening amount. Typically, it is added to a plating bath in the amount of about 50 to about 2,000 ppm (about 0.05 to 20 grams per liter) based on the weight of the bath.

The aqueous electroplating bath of the present invention contains a controlled amount of zinc ions and a controlled amount of one or more additional metal ions which alloy with the zinc to produce a desired result. The alloying metal ions which can be used in the present invention are from the first transition of the Periodic Table. Nickel, cobalt, iron, and combinations thereof are commonly used alloying materials which are particularly useful in the present invention. Other examples of alloying metals that can be used in the present invention include manganese, and chromium.

For an alkaline bath, the zinc ions are usually added by means of a zinc compound such as an oxide or sulfate salt in combination with a strong base such as sodium hydroxide or potassium hydroxide. The predominant zinc species in the bath, at high pH, is generally the zincate ion.

Normally, the alkaline bath is prepared by dissolving the zinc oxide or salt in a commercially available caustic solution and then adjusting the concentration of the solution to that desired by adding water to the solution. For instance, 10 grams of zinc oxide can be dissolved in 75 ml of a 50% caustic solution, which is then diluted to the desired volume percent by the addition of water.

If desired, the pH of the bath can be adjusted by adding to the bath the parent base of the zinc salt, or another base, such as sodium or potassium carbonate.

The zinc ions are added to the bath, in the case of making an acid bath, in the form of a zinc salt such as a sulfate, acetate, sulfamate, chloride, or fluoroborate. The pH of the bath may be adjusted by employing an acid corresponding to the zinc salt used. Thus, depending upon the particular zinc salt in the bath, sulfuric acid, hydrochloric acid, fluoroboric acid, acetic acid, or sulfamic acid can be added to the bath to provide the operating pH which is desired.

The concentration of the zinc ions in the bath, for an electroplating bath, can vary in accordance with conventional practice. The zinc ion concentration typically ranges from about 4,000 ppm (about 4 grams per liter) to about 50,000 ppm (about 50 grams per liter). For an acid bath, the concentration of zinc ions typically is at the high end of this range.

The alloying metal ions are also introduced into the bath in the form of an oxide or sulfate in the case of an alkaline bath or in the form of an aqueous soluble salt, such as a chloride, sulfate, fluoroborate, acetate, or sulfamate, in the case of an acid bath. The concentration range of the alloying metal ions, in the practice of the present invention, typically is in the range between about 20 ppm to about 20,000 ppm (about 0.02 to about 20 grams per liter). If combinations of alloying metals are used, each alloying metal can be present in the range of about 20 ppm to about 20,000 ppm. Normally, the amount of alloying metal ions in the bath will be in the weight range necessary to produce, in the plate which is deposited, about 0.1%–1% by weight alloying element.

In addition to the use of a quaternary ammonium polymer of the present invention, the electroplating bath can contain, as a supplemental brightener, conventional brighteners such as sodium saccharin, anisic aldehyde, polyvinyl alcohol, polyethyleneimine, N-benzyl nicotinic acid (sodium salt), the reaction product of epichlorohydrin with an amine, an aromatic aldehyde, benzylidene acetone, and derivatives of polyethylene glycol. These supplemental brighteners can be used in the bath of the present invention in conventional amounts, in combination with the quaternary ammonium compound of the present invention.

The electroplating bath of the present invention also preferably employs a complexing agent, in the case of an alkaline bath. Examples of suitable complexing agents for an alkaline bath are sorbitol, gluconic acid, heptanoic acid, tartaric acid, glycine, ethylenediamine tetraacetic acid, triethanolamine, salts thereof, and combinations thereof.

In the practice of the present invention, the bath is operated with an average cathode current density in the range of about 10 amps per square foot to about 25 amps per square foot, typically about 20 amps per square foot. The cathode current density is dependent upon the particular type of deposit desired.

The following Examples illustrate the present invention. In all of the Examples, the ureylene quaternary ammonium polymer was Mirapol A-15.

Examples 1–3

In these Examples, the following brightener compositions were prepared.

| | |
|---|---|
| **Brightener Composition 1** | |
| Ureylene quaternary ammonium polymer | 200 grams/liter |
| Polyvinyl alcohol | 10 grams/liter |
| **Brightener Composition 2** | |
| Ureylene quaternary ammonium polymer | 150 grams/liter |
| Anisic aldehyde | 5 grams/liter |
| **Brightener Composition 3** | |
| Ureylene quaternary ammonium polymer | 100 grams/liter |
| Benzylidene acetone | 50 grams/liter |
| Methanol | 150 ml/liter |

In the brightener compositions 1, 2 and 3, the polyvinyl alcohol, anisic aldehyde, benzylidene acetone and methanol function as supplemental brightening agents.

Example 1

The following alkaline plating bath was prepared.

| Ingredient | Amount Based on Bath |
|---|---|
| Zinc ions | 7.5 grams/liter |
| Cobalt ions | 100 ppm |
| Sodium hydroxide | 75 grams/liter |
| Gluconic acid (complexing agent) | 5 grams/liter |
| Brightener composition 1 | 1% by weight |

The bath was added to a 267 ml Hull cell. A brass Hull cell panel was plated at three amperes for five minutes. The Hull cell panel was bright and level above a current density of five amps/square foot. The zinc alloy deposit contained 0.6% by weight cobalt.

Example 2

The following alkaline plating bath was prepared:

| Ingredient | Amount Based on Bath |
|---|---|
| Zinc ions | 15 grams/liter |
| Iron ions | 50 ppm |
| Chromium ions | 25 ppm |
| Sodium hydroxide | 100 grams/liter |
| Triethanolamine (complexing agent) | 5 grams/liter |
| Brightener composition 2 | 2% by weight |

The bath was added to a 267 ml Hull cell. A steel Hull cell panel was plated at three amperes for five minutes. The Hull cell panel was bright at all current densities. The zinc alloy deposit contained 0.3% by weight iron and 0.025% by weight chromium.

Example 3

The following acid plating bath was prepared.

| Ingredient | Amount Based on Bath |
|---|---|
| Zinc ions | 50 grams/liter |
| Cobalt ions | 2 grams/liter |
| Nickel ions | 2 grams/liter |
| Potassium chloride[1/] | 150 grams/liter |
| Boric acid[2/] | 35 grams/liter |
| Sodium benzoate[3/] | 2 grams/liter |
| Tergitol-S-15 (Trademark Union Carbide Corporation)[4/] | 5 grams/liter |
| o-Chlorobenzaldehyde[5/] | 0.1 grams/liter |
| Brightener composition 3 | 2 ml/liter |

[1/]To enhance the bath conductivity.
[2/]To minimize high current density burning.
[3/]Brightener additive.
[4/]Brightener additive.
[5/]Brightener additive.

The bath was added to a 267 ml Hull cell. A brass Hull cell panel was plated at two amperes for five minutes. The Hull cell panel was bright above about 20 amps/square foot. The zinc alloy deposit contained cobalt and nickel.

Example 4

This Example demonstrates that a high level of brightness is obtained by the present invention with little or no auxiliary additives.

The following alkaline plating bath was prepared.

| Ingredient | Amount Based on Bath |
|---|---|
| Zinc oxide | 10 grams/liter |
| Ferric sulfate | 0.1 grams/liter |
| Sodium hydroxide | 90 grams/liter |
| Gluconic acid | 5 grams/liter |

The gluconic acid functions as a complexing agent.

A first sample of the plating bath was prepared containing 0.6 grams/liter of ureylene quaternary ammonium polymer. A first control sample of the plating bath was also prepared containing 0.6 grams/liter of the reaction product of epichlorohydrin and dimethylaminopropylamine. Steel Hull cell panels were plated at a current of three amperes for five minutes and 0.5 amperes for ten minutes.

A second sample of the plating bath was prepared containing, in addition to the ureylene quaternary ammonium polymer, 0.00125 grams/liter of 1-benzyl-3-pyidene carboxylic acid, sodium salt, as a supplemental brightening agent. A second control sample of the plating bath was also prepared, containing, in addition to the reaction product of epichlorohydrin and dimethylaminopropylamine, 0.00125 grams/liter of the 1-benzyl-3-pyridine carboxylic acid, sodium salt. Steel Hull cell panels were plated with the second sample and second control sample in the same way as the first sample and first control sample.

The results are given in the following Table 1.

TABLE 1

| | Hull Cell Panel Results | |
|---|---|---|
| Sample | 3 Amps for 5 Minutes | 0.5 Amps for 10 Minutes |
| First sample | Bright at all current densities | Bright with a slightly cloudy deposition below a current density of 0.1 amps/square foot |
| First control sample | Semi-bright with hydrogen gas pits | Dull below 3 amps/square foot |
| Second sample | Mirror bright at all current densities | Mirror bright at all current densities |
| Second control sample | Level of brightness improved, over first control sample, above about 60 amps/square foot, but was dull with dark streaks below 60 amps/square foot | Dull below about five amps/square foot |

The test was repeated with all conditions the same except that cobalt sulfate was used in place of ferric sulfate. The results using cobalt sulfate paralleled the results using ferric sulfate.

From the above description of the invention, those skilled in the art will perceive improvements, changes and modifications. Such improvements, changes and modifications within the skill of the art are intended to be covered by the appended claims.

Having described the invention, the following is claimed:

1. A zinc alloy electroplating bath comprising zinc ions, alloying metal ions of metals of the first transition of the Periodic Table, and a brightening agent of a ureylene quaternary ammonium polymer, an iminoureylene quaternary ammonium polymer, or a thioureylene quaternary ammonium polymer.

2. The bath of claim 1 wherein said polymer of the brightening agent is a ureylene quaternary ammonium polymer.

3. The bath of claim 1 wherein said polymer of the brightening agent has a molecular weight in the range of 350 to 2,000.

4. The bath of claim 1 having a pH in the range of about 9 to 13 and further comprising an amount of a complexing agent.

5. The bath of claim 1 wherein said alloying metal ions are ions of iron, nickel, cobalt, manganese, chromium, or combinations thereof.

6. The bath of claim 5 comprising about 4,000 to about 50,000 ppm of said zinc ions and about 20 ppm to about 2,000 ppm of said ions of the alloying metal.

7. The bath of claim 1 comprising about 50 to about 2,000 ppm of the quaternary ammonium polymer.

8. A process of electrodepositing a zinc alloy onto a metal substrate comprising the steps of:

(a) positioning said metal substrate in the electroplating bath of claim 1; and (b) applying an electrodepositing current to said bath.

9. The process of claim 8 wherein said current is at an average cathode current density in the range of about 10 amps/square foot to about 25 amps/square foot.

10. A zinc alloy electroplating bath comprising zinc ions, alloying metal ions of metals of the first transition of the Periodic Table, and a brightening agent of a quaternary ammonium polymer having repeating groups of the formula

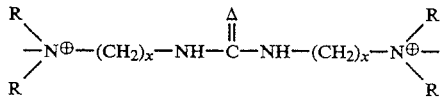

(1)

or

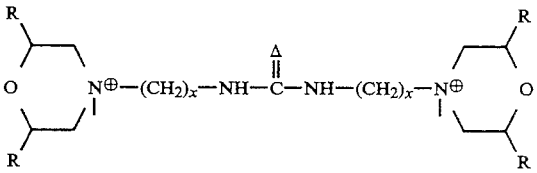

(2)

wherein

Δ is O, S or N, x is 2 or 3

R is hydrogen in formula (2), or methyl, ethyl, isopropyl, 2-hydroxy-ethyl or $-CH_2CH_2(OCH_2CH_2)_yOH$, y being 0–6, in either formula (1) or (2) in alternating sequence with ethoxyethane or methoxyethane groups.

11. A process for electrodepositing a zinc alloy onto a metal substrate comprising the steps of:

(a) preparing an electroplating bath comprising (i) zinc ions, (ii) alloy metal ions of metals of the first transition of the Periodic Table, and (iii) a brightening agent of a ureylene quaternary ammonium polymer, an iminoureylene quaternary ammonium polymer, or a thioureylene quaternary ammonium polymer;

(b) positioning a metal substrate into said bath; and (c) applying an electrodepositing current to said bath.

12. The process of claim 11 wherein said polymer of the brightening agent is a ureylene quaternary ammonium polymer.

13. The process of claim 11 wherein said polymer of the brightening agent has a molecular weight in the range of 350 to 2,000.

14. The process of claim 11 wherein said bath has a pH in the range of about 9 to 13 and further comprises an amount of a complexing agent.

15. The process of claim 11 wherein said alloying metal ions are ions of iron, nickel, cobalt, manganese, chromium, or combinations thereof.

16. The process of claim 15 wherein said bath comprises about 4,000 to about 50,000 ppm of said zinc ions and about 20 ppm to about 2,000 ppm of said ions of the alloying metal.

17. The process of claim 11 wherein said bath comprises about 50 to about 2,000 ppm of the quaternary ammonium polymer.

18. The process of claim 11 wherein said current is at an average cathode current density in the range of about amps/square foot to about 25 amps/square foot.

19. A process for electrodepositing a zinc alloy onto a metal substrate comprising the steps of:

(a) preparing an electroplating bath comprising:

(i) zinc ions, (ii) alloy metal ions, and (iii) a brightening agent of a quaternary ammonium polymer having repeating groups of the formula

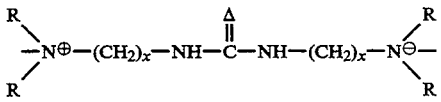

(1)

or

-continued

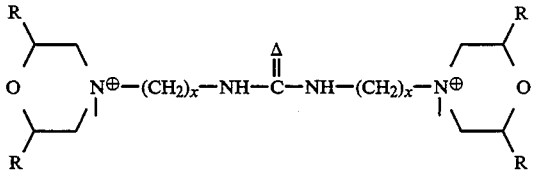

(2)

wherein

Δ is O, S or N, x is 2 or 3

R is hydrogen in formula (2), or methyl, ethyl, isopropyl, 2-hydroxy-ethyl or $—CH_2CH_2(OCH_2CH_2)_yOH$, y being 0–6, in either formula (1) or (2) in alternating sequence with ethoxyethane or methoxyethane groups, (b) positioning a metal substrate into said bath; and (c) applying an electrodepositing current to said bath.

* * * * *

UNITED STATES PATENT AND TRADEMARK OFFICE

CERTIFICATE OF CORRECTION

PATENT NO. : 5,405,523

DATED : April 11, 1995

INVENTOR(S) : William E. Eckles

It is certified that error appears in the above-indentified patent and that said Letters Patent is hereby corrected as shown below:

Column 2, line 20, before "2,000" insert --about--.

Column 2, line 22, change "13" to --14--.

Column 2, line 26, change "2,000" to --20,000--.

Column 2, line 44, change "13" to --14--.

Column 4, line 7, change "20" to --2--.

Column 7, line 4, change "pyidene" to --pyridene--.

Column 7, line 57, before "2,000" insert --about--.

Column 7, line 59, change "13" to --14--.

Column 7, line 66, change "2,000" to --20,000--.

Column 8, line 55, before "2,000" insert --about--.

Column 8, line 57, change "13" to --14--.

UNITED STATES PATENT AND TRADEMARK OFFICE

CERTIFICATE OF CORRECTION

PATENT NO. : 5,405,523

DATED : April 11, 1995

INVENTOR(S) : William E. Eckles

It is certified that error appears in the above-indentified patent and that said Letters Patent is hereby corrected as shown below:

Column 8, line 64, change "2,000 ppm of said ions" to --20,000 ppm of ions--.

Column 9, line 3, after "about" (first occurence), insert --10--.

Signed and Sealed this

Thirty-first Day of October 1995

*Attest:*

Bruce Lehman

BRUCE LEHMAN

*Attesting Officer*

*Commissioner of Patents and Trademarks*